US011878224B2

(12) United States Patent
Boggess et al.

(10) Patent No.: US 11,878,224 B2
(45) Date of Patent: Jan. 23, 2024

(54) ELEVATED YARD GAME

(71) Applicant: Mountainville Commerce LLC, Alpine, UT (US)

(72) Inventors: Bart Boggess, Alpine, UT (US); Jerry Boggess, Boca Raton, FL (US); Ian Boggess, Alpine, UT (US)

(73) Assignee: Mountainville Commerce LLC, Alpine, UT (US)

( * ) Notice: Subject to any disclaimer, the term of this patent is extended or adjusted under 35 U.S.C. 154(b) by 0 days.

(21) Appl. No.: 17/008,328

(22) Filed: Aug. 31, 2020

(65) Prior Publication Data

US 2021/0062535 A1 Mar. 4, 2021

Related U.S. Application Data

(60) Provisional application No. 62/894,688, filed on Aug. 31, 2019.

(51) Int. Cl.

| | |
|---|---|
| ***A63B 67/00*** | (2006.01) |
| ***E04H 15/44*** | (2006.01) |
| ***E04H 15/60*** | (2006.01) |
| ***A63G 33/00*** | (2006.01) |
| ***A63B 6/00*** | (2006.01) |
| ***E04H 15/32*** | (2006.01) |
| ***A63B 67/06*** | (2006.01) |

(Continued)

(52) U.S. Cl.

CPC ..... *A63B 67/002* (2013.01); *A63B 69/00* (2013.01); *A63G 33/00* (2013.01); *E04H 15/006* (2013.01); *E04H 15/44* (2013.01); *E04H 15/60* (2013.01); *A63B 2067/061* (2013.01); *A63C 2019/085* (2013.01); *E04H 2015/326* (2013.01)

(58) Field of Classification Search

CPC ..... E04H 15/006; E04H 15/326; E04H 15/44; E04H 2015/326; A63B 63/007; A63B 67/002; A63B 67/06; A63B 2067/061; A63B 67/066; A63C 19/06; A63C 2019/085

See application file for complete search history.

(56) References Cited

U.S. PATENT DOCUMENTS 785,571 A * 3/1905 Raines et al. ..... E04H 15/48 135/142
4,706,696 A * 11/1987 Gillis ..... E04H 15/425 135/127

(Continued)

*Primary Examiner* — David R Dunn
*Assistant Examiner* — Danielle Jackson
(74) *Attorney, Agent, or Firm* — Kunzler Bean & Adamson

(57) ABSTRACT

Embodiments described herein relate to a system which includes a first vertical support, a second vertical support parallel to the first vertical support, a third vertical support parallel to the first vertical support, and a fourth vertical support parallel to the first vertical support, a first, second, third, and fourth elevation couplers releasably attachable proximate an end of the corresponding vertical supports, a first, second, third, and fourth outer horizontal members releasably coupleable to extend between the elevation couplers perpendicular to the vertical supports, and first and second inner horizontal member extending between the outer horizontal members to be oriented substantially perpendicular to the vertical supports and overlap each other to form an elevated grid suitable for a game.

20 Claims, 12 Drawing Sheets

(51) Int. Cl.

| | |
|---|---|
| ***A63C 19/08*** | (2006.01) |
| ***E04H 15/00*** | (2006.01) |
| ***A63B 69/00*** | (2006.01) |

(56) References Cited

U.S. PATENT DOCUMENTS

| | | | | | |
|---|---|---|---|---|---|
| 5,795,267 | A * | 8/1998 | Weaver | A63B 5/11 | 482/23 |
| 5,984,837 | A * | 11/1999 | Weaver | A63B 5/11 | 135/116 |
| 6,230,728 | B1 * | 5/2001 | Reese | E04H 15/28 | 135/127 |
| 6,591,849 | B1 * | 7/2003 | Swetish | E04H 15/46 | 135/123 |
| 7,146,995 | B2 * | 12/2006 | Lapping | E04H 15/44 | 135/121 |
| 7,219,681 | B1 * | 5/2007 | Hamilton-Jones | E04H 15/322 | 135/119 |
| 7,608,000 | B2 * | 10/2009 | Butler | A63B 24/00 | 473/415 |
| D650,445 | S * | 12/2011 | Otey | D21/300 | |
| D656,995 | S * | 4/2012 | Otey | D21/300 | |
| 2006/0283493 | A1 * | 12/2006 | Charles | E04H 1/1266 | 135/121 |
| 2007/0049425 | A1 * | 3/2007 | Butler | A63B 24/00 | 473/415 |
| 2008/0125252 | A1 * | 5/2008 | Butler | A63B 67/002 | 473/415 |
| 2016/0339314 | A1 * | 11/2016 | Parsons | E04H 15/02 | |

* cited by examiner

ELEVATED YARD GAME

CROSS-REFERENCE TO RELATED APPLICATIONS

The present application claims priority to U.S. Provisional Patent Application No. 62/894,688 entitled "ELEVATED YARD GAME", filed on 31 Aug. 2019. The entire contents of the above-listed application are hereby incorporated by reference for all purposes.

BACKGROUND

With more neighborhoods becoming urbanized, there is a need for simple games that can be played in the protection and security of one's own back yard or smaller outdoor or indoor spaces. Most popular organized sports (such as baseball, football, or soccer) require a significant number of players and a significantly large indoor or outdoor area where balls or other game implements can be used.

BRIEF DESCRIPTION OF THE DRAWINGS

These and other features, aspects, and advantages of the present invention will become better understood with regard to the following description and accompanying drawings where.

It will be appreciated that the drawings are illustrative and not limiting of the scope of the invention. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the disclosure. Examples described herein provide an elevated yard game which has reduced weight, cost, and packed size while providing an adjustable, resilient structure.

Conventional multi-square game systems include a huge array of piping and connectors with bring cost, weight, bulk, and complexity to the system. Embodiments described herein provide an approach which reduces cost, weight, bulk, complexity, and further provides adjustability beyond what is possible with the convention multi-square game systems.

Figure 1:
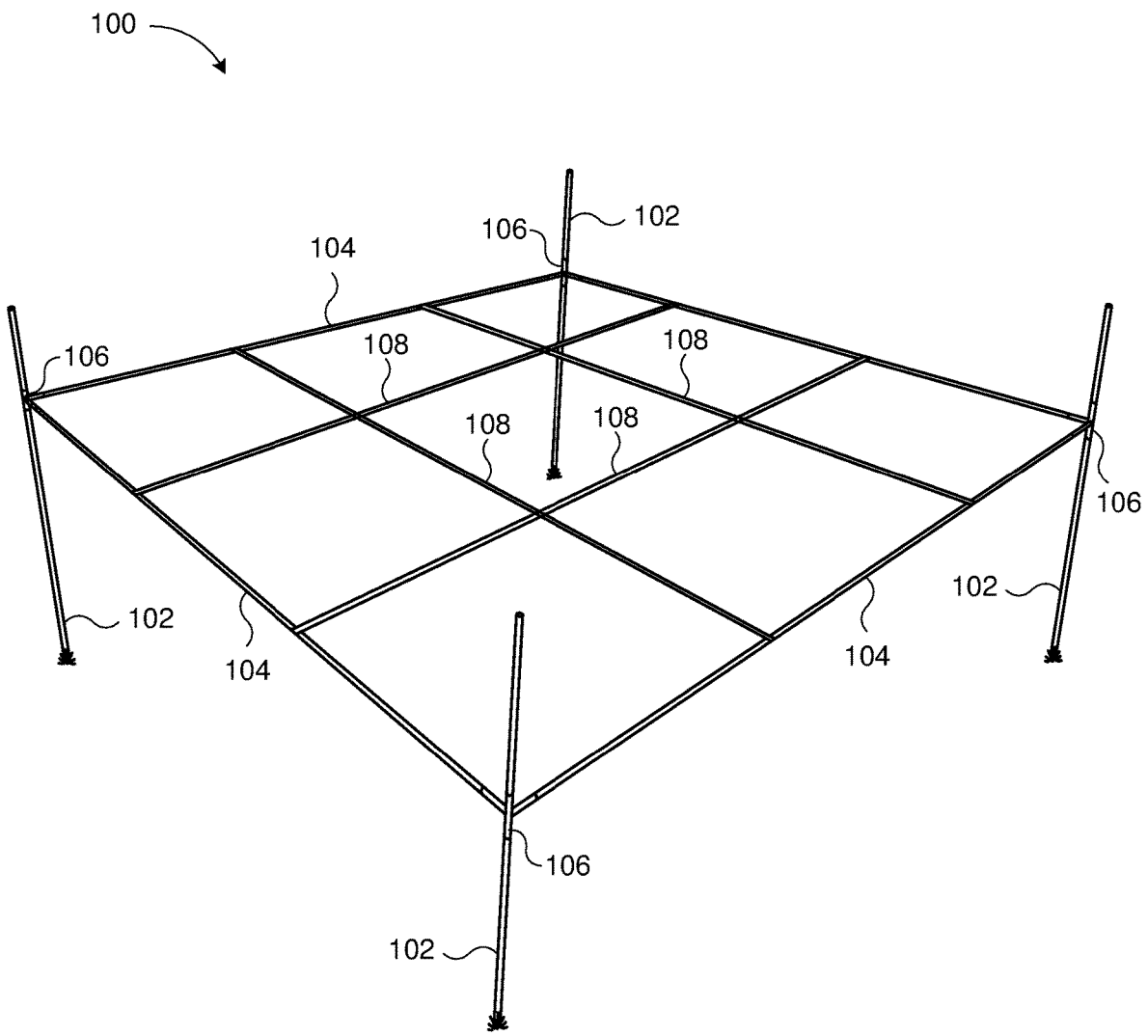
FIG. 1 shows a perspective view of one embodiment of an elevated yard game system in accordance with one or more aspects of the present invention.

FIG. 1 shows a perspective view of one embodiment of an elevated yard game system 100 in accordance with one or more aspects of the present invention. The system 100 shown allows for flexibility in setup, reduced cost and weight, and lower packed size when broken down for transporting.

In the illustrated embodiment, the elevated yard game system 100 includes a plurality of vertical supports 102. In the illustrated embodiment, each of the vertical supports 102 is positioned at a corresponding corner of the system 100 to form a square. The vertical supports 102 may be rigid and be made of a material of sufficient strength to support a weight of the system 100 and have sufficient rigidity to resist deflection or bending in response to forces applied to the vertical supports 102. In some embodiments, the vertical supports 102 may include a plastic, metal, composite, wood, or other synthetic or natural materials or combination of materials.

The system 100 also includes outer horizontal members 104. In the illustrated embodiment, the outer horizontal members 104 couple to the vertical supports 102 to be between a corresponding two of the vertical supports 102. The outer horizontal members 104 may be coupled to the vertical supports 102 directly or, as shown, via a coupler such as the adjustable elevation coupler 106 shown and described in more detail below with reference to FIG. 2.

The outer horizontal members 104 may be flexible, semi-rigid, or rigid structures. In some embodiments, the outer horizontal members 104 are similar, in at least one of sizing and materials, to the vertical supports 102. In other embodiments, the outer horizontal members 104 are flexible elements such as straps, cords, or the like. In some embodiments, the outer horizontal members 104 are adjustable along a height of the vertical supports.

The system 100 also includes inner horizontal members 108. In some embodiments, the inner horizontal members 108 are flexible structures such as a strap, cable, cord, rope, ribbon, or the like. In some embodiments, the inner horizontal members 108 couple to the outer horizontal members 104 to form a grid pattern within the bounds of the outer horizontal members 104. As shown herein, the grid pattern is a 3×3 pattern forming nine individual regions or areas within the system 100. Fewer or more regions or areas may be formed without departing from the scope of the disclosure. For example, a 2×2 pattern forming four different areas may be incorporated. Other non-square shapes may also be formed by adjusting the number and relative angles of the outer horizontal members 104 and the inner horizontal members 108.

The inner horizontal member 108 may be separate from one another or one or more of the inner horizontal members 108 may be coupled to at least one other of the inner horizontal members 108. For example, the inner horizontal members 108 may be allowed to simply cross over one another within the system 100 near the center or may be stitched, adhered, bonded, looped, or otherwise connected together in a permanent or semi-permanent manner.

One or more of the inner horizontal members 108 may be adjustable in length to change or adjust a tension in the inner horizontal members 108 and, thus, a force applied to the outer horizontal members 104. This is described in greater detail below.

In some embodiments, the system 100 may further include securing elements such as stakes and lines coupled to the vertical supports 102 or other components of the system 100. In some embodiments, the vertical supports 102 are configured to be driven into a play surface such as grass, sand, dirt, or the like to stabilize the system 100. Users may play a game with the system 100 by standing within the system 100 beneath the inner horizontal members 108 to be below a corresponding square in the pattern of squares formed by the inner horizontal members 108. A ball or other implement may be passed between players by sending the ball up through your corresponding square to come down in a target player's corresponding square. Other variations and manners of play may be used.

Figure 2:
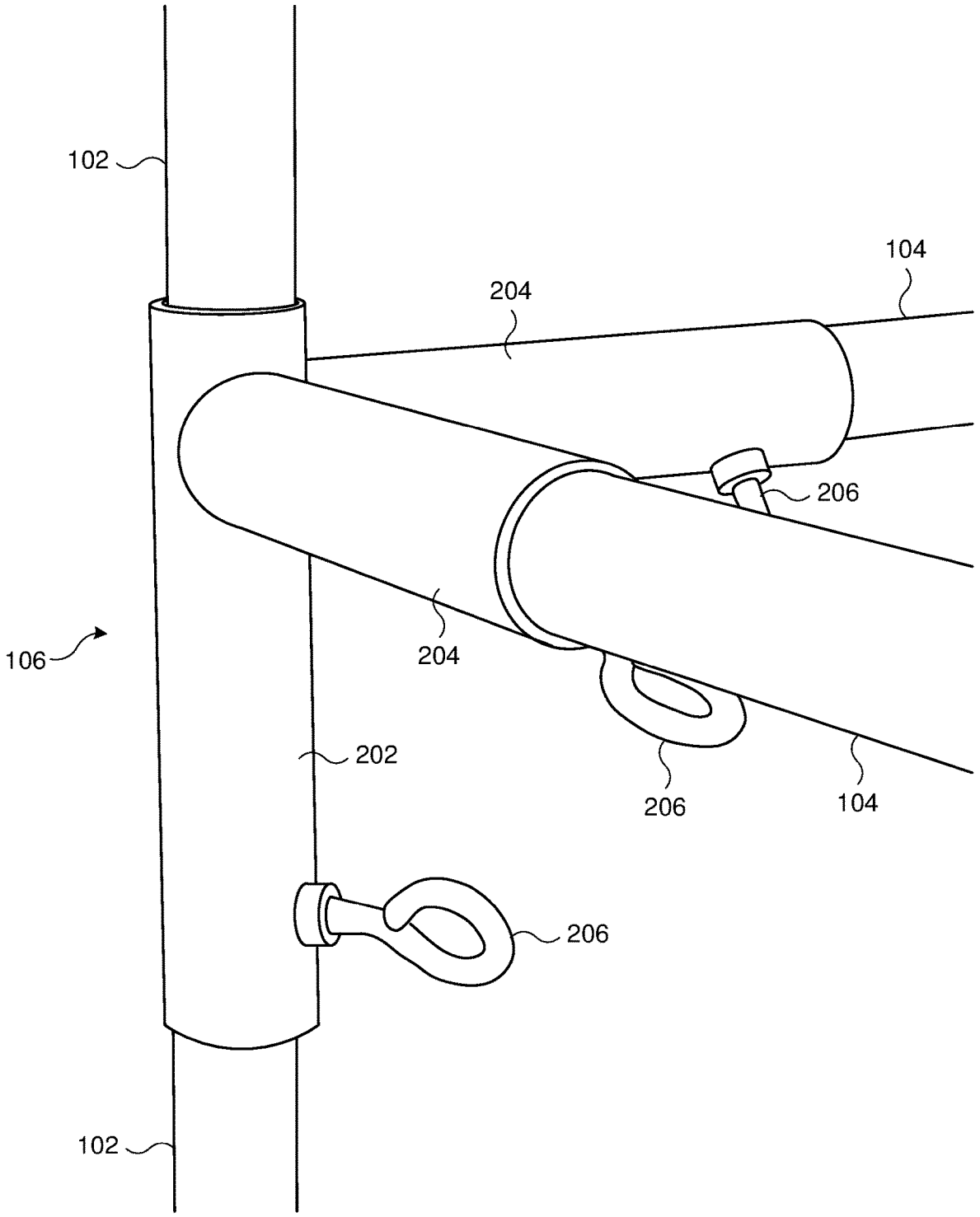
FIG. 2 shows a perspective top view of an adjustable elevation coupler of the elevated yard game system in accordance with one or more aspects of the present invention.

FIG. 2 shows a perspective top view of an adjustable elevation coupler 106 of the elevated yard game system 100 of FIG. 1 in accordance with one or more aspects of the present invention. The elevation coupler 106 allows for adjustability in height of the system 100 allowing for use in a wider variety of locations and accommodations for players of various sizes and situations.

In the illustrated embodiment, the adjustable elevation coupler 106 couples the outer horizontal members 104 to the vertical supports 102 at each corner of the system 100. In the illustrated embodiment, the adjustable elevation coupler 106 includes a vertical sleeve 202 and two horizontal sleeves 204. While each of the sleeves 202 and 204 are shown as being positioned to extend outward at a 90° angle relative to one another, other angles may also be incorporated.

The sleeves 202 and 204 are shown as having a circular cross-section but may incorporate a non-circular cross-section in one or more of the sleeves 202 and 204. In the illustrated embodiment, the horizontal sleeves 204 are sized to receives the outer horizontal members 104 into an interior of the horizontal sleeves 204. In other embodiments, the horizontal sleeves 204 may be sized to be inserted into an interior of the outer horizontal members 104.

In the illustrated embodiment, the adjustable elevation coupler 106 includes a securing mechanism 206 on each of the sleeves 202 and 204. The securing mechanism 206 on each of the horizontal sleeves 204 secures the outer horizontal members 104 relative to the corresponding horizontal sleeve 204. The securing mechanism 206 disposed on the vertical sleeve 202 secures the adjustable elevation coupler 106 relative to the vertical support 102. This allows a position of the adjustable elevation coupler 106 to be changed along the vertical support 102 allowing for an elevation adjustment of the outer horizontal members 104. This may be advantageous for accommodating players of various heights, terrain irregularities, game rules or style, player skill, or the like.

In the illustrated embodiment, the securing mechanisms 106 are eyelet bolts which can be tightened to apply a friction force on the corresponding vertical support 102 or outer horizontal member 104. Other securing mechanisms may also be used. For example, mechanisms such as pin and hole, slot lock, friction collar, spring pin, twist lock, magnetic lock, and the like may be implemented.

Figure 3:
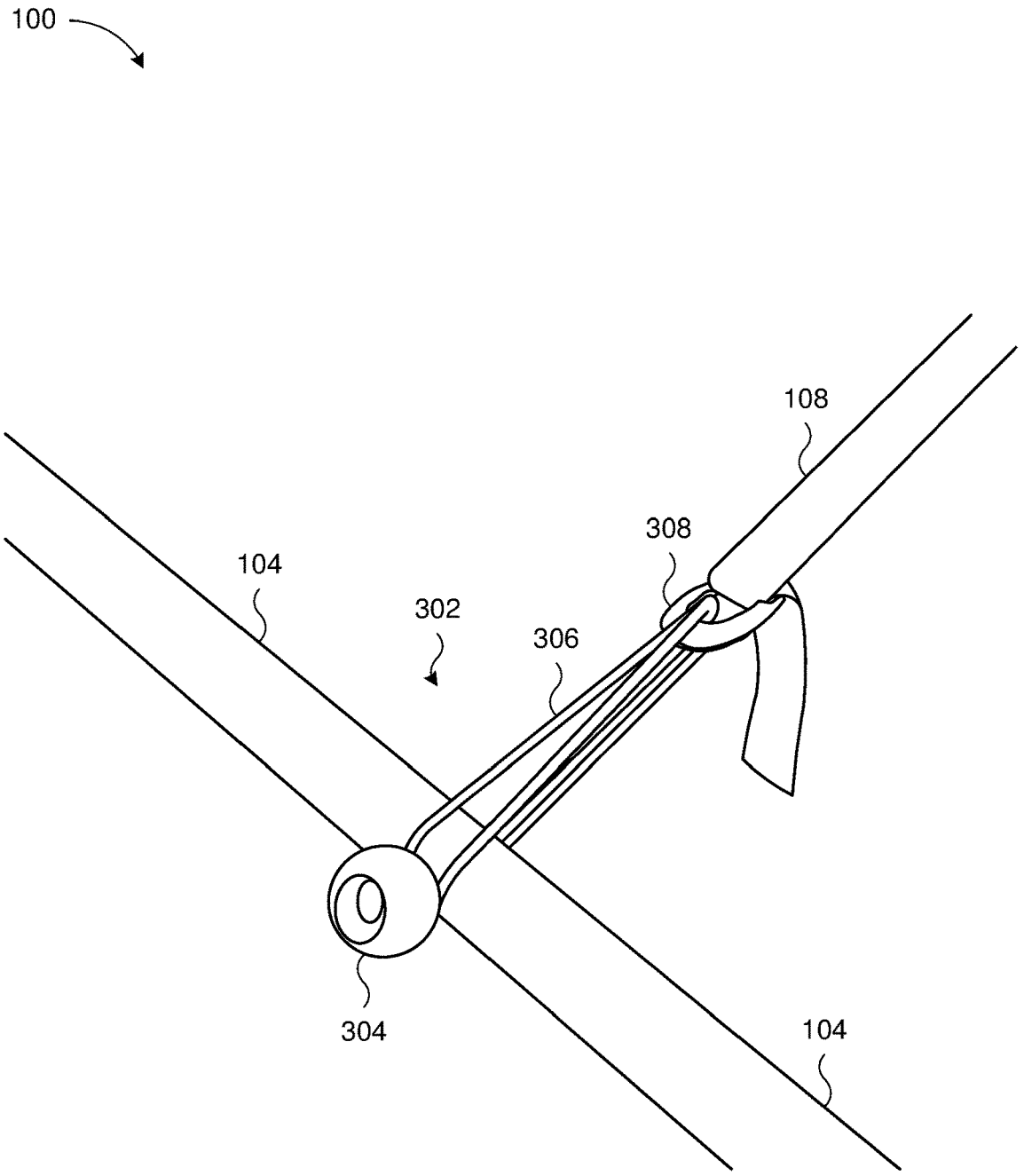
FIG. 3 shows a perspective view of one embodiment of a suspension shackle of the elevated yard game system in accordance with one or more aspects of the present invention.

FIG. 3 shows a perspective view of one embodiment of a suspension shackle 302 of the elevated yard game system 100 in accordance with one or more aspects of the present invention. the suspension shackle 302 allows for quick and easy setup with a reduced weight and cost in the system 100. In the illustrated embodiments, the suspension shackle 302 couples the inner horizontal member 108 to a corresponding one of the outer horizontal members 104.

The illustrated embodiment of the suspension shackle 302 includes a retaining structure 304, a securing loop 306, and a connector 308. The retaining structure 304 may be a ball, or other shape, which can retain the securing loop 306 when the securing loop 306 is passed through the connector 308, around the outer horizontal member 104, and over the retaining structure 304. In some embodiments, the securing loop 306 includes an elastic material such as a shock cord or the like which applies a dynamic force to the inner horizontal member 108 to maintain a tension force and absorb impulse energy from a hit or otherwise deform or sacrifice itself to prevent damage to the system 100. In some embodiments, the suspension shackle 302 may be configured to release from one or both of the outer horizontal member 104 and the inner horizontal member 108 in response to experiencing an otherwise damaging load.

The connector 308 may be configured to receive the inner horizontal member 108 and secure the inner horizontal member 108 through friction or in another manner. For example, the connector 308 may be a loop slider which doubles the inner horizontal member 108 onto itself within the connector 308 to retain the inner horizontal member in place. Adjustability at the connector 308 may be beneficial for adjustment of tension on the inner horizontal member 108.

In other embodiments, the connector 308 may be sewn into a loop in the inner horizontal member 108 or otherwise be removably or non-removably coupled to one or more of the inner horizontal member 108 and the securing loop 306. This may be beneficial for organization and maintaining components of the system 100 together in their respective locations and assemblies.

Figure 4:
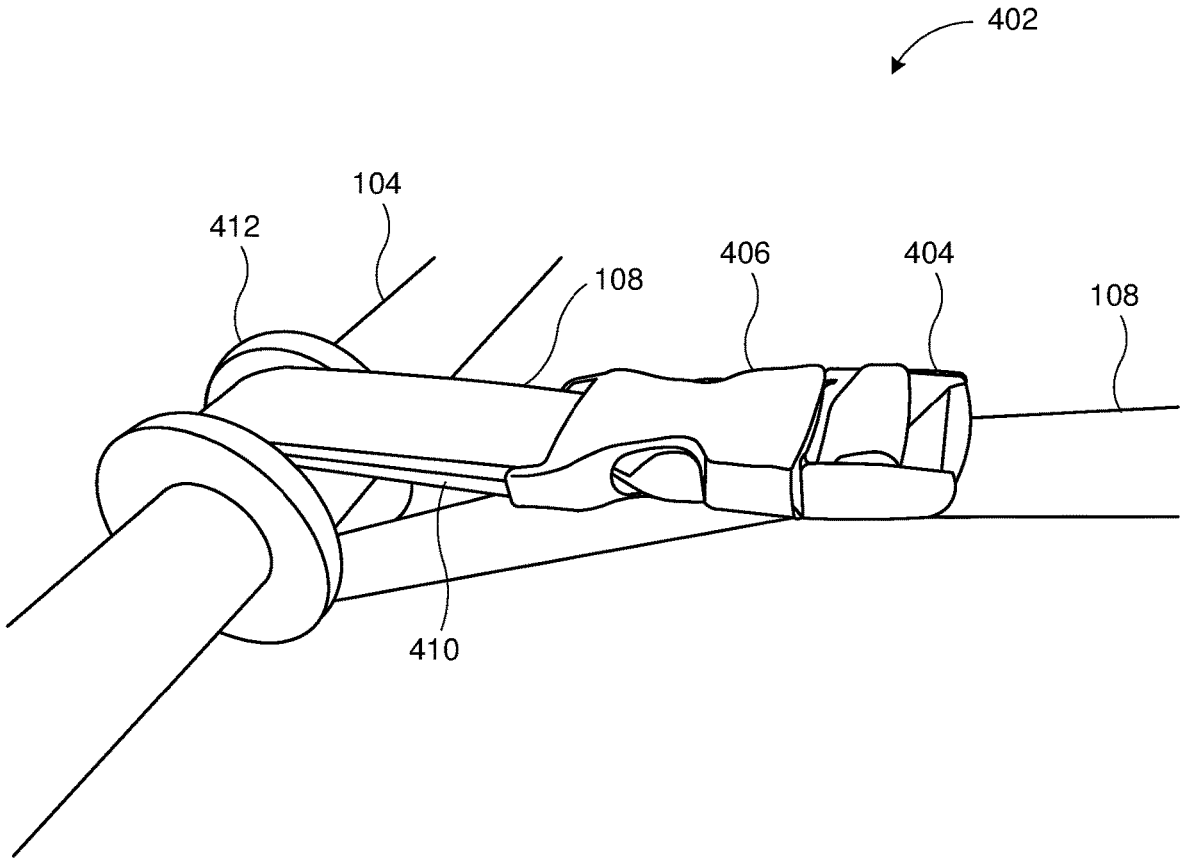
FIG. 4 shows a perspective view of one embodiment of a suspension clip coupler of the elevated yard game system in accordance with one or more aspects of the present invention.

FIG. 4 shows a perspective view of one embodiment of a suspension clip coupler 402 of the elevated yard game system 100 in accordance with one or more aspects of the present invention. The suspension clip coupler 402 allows a user to quickly setup or adjust the system 100 in an easy and intuitive manner. In the illustrated embodiment, the suspension clip coupler 402 secures the inner horizontal member 108 relative to a corresponding one of the outer horizontal member 104. In the illustrated embodiment, the suspension clip coupler 402 includes a first buckle end 404 which is secured along a length of the inner horizontal member 108 and a second buckle end 406 which is disposed on an end of the inner horizontal member 108 to receive the first buckle end 404. In some embodiments, the first buckle end 404 is adjustable along the inner horizontal member 108 to adjust a tension of the inner horizontal member 108.

The suspension clip coupler 402 may also include a tension element 410 such as a shock cord or other elastic member which applies a tension force to the inner horizontal member 108. The suspension clip coupler 402 may be positioned on the outer horizontal member 104 to correspond to a retaining collar 412 of the system 100 which is described in greater detail below with reference to FIG. 6.

The suspension clip coupler 402 may provide a quick release manner of coupling the inner horizontal member 108 to the outer horizontal member 104 reducing a requisite level or skill, time, and strength to assemble the corresponding portion of the system 100.

Figure 5:
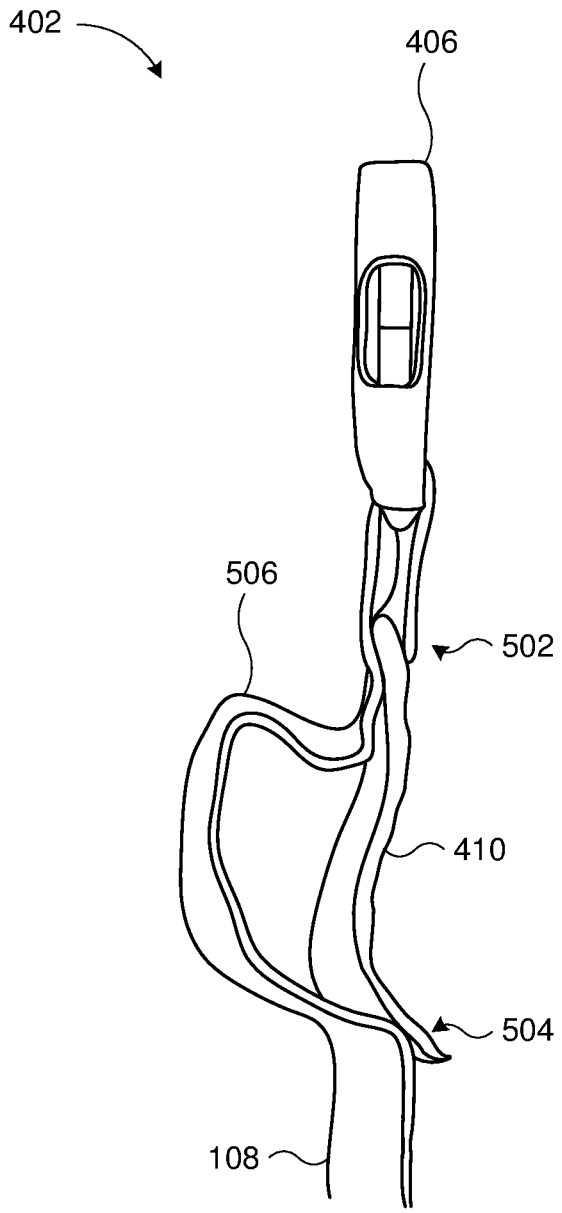
FIG. 5 shows a side view of one embodiment of the suspension clip coupler of the elevated yard game system in accordance with one or more aspects of the present invention.

FIG. 5 shows a side view of one embodiment of the suspension clip coupler 402 of the elevated yard game system 100 in accordance with one or more aspects of the present invention. The suspension clip coupler 402 may provide for an ease of setup with reduced chance of injury and need for adjustment.

In the illustrated embodiment, the tension element 410 of the suspension clip coupler 402 is coupled to the inner horizontal element 108 at a first joining 502 to secure the inner horizontal member 108 to the second buckle end 406 and the tension element 410 to the inner horizontal member 108. A second joining 504 is formed by joining the tension element 410 to the inner horizontal member 108 at a distance along the length of the inner horizontal member 108 sufficient to form an extension loop 506 in the inner horizontal member 108 when the tension element 410 is under little or no tensile load.

In some embodiments, the extension loop 506 is sufficient in length to allow the tension element 410 to extend in elastic deformation and apply tension to the inner horizontal member 108. At full or greater extension of the tension element 410, the extended length of the tension element 410 becomes equal to the length of the extension loop 506 and prevents over-extension of the tension element 410.

Figure 6:
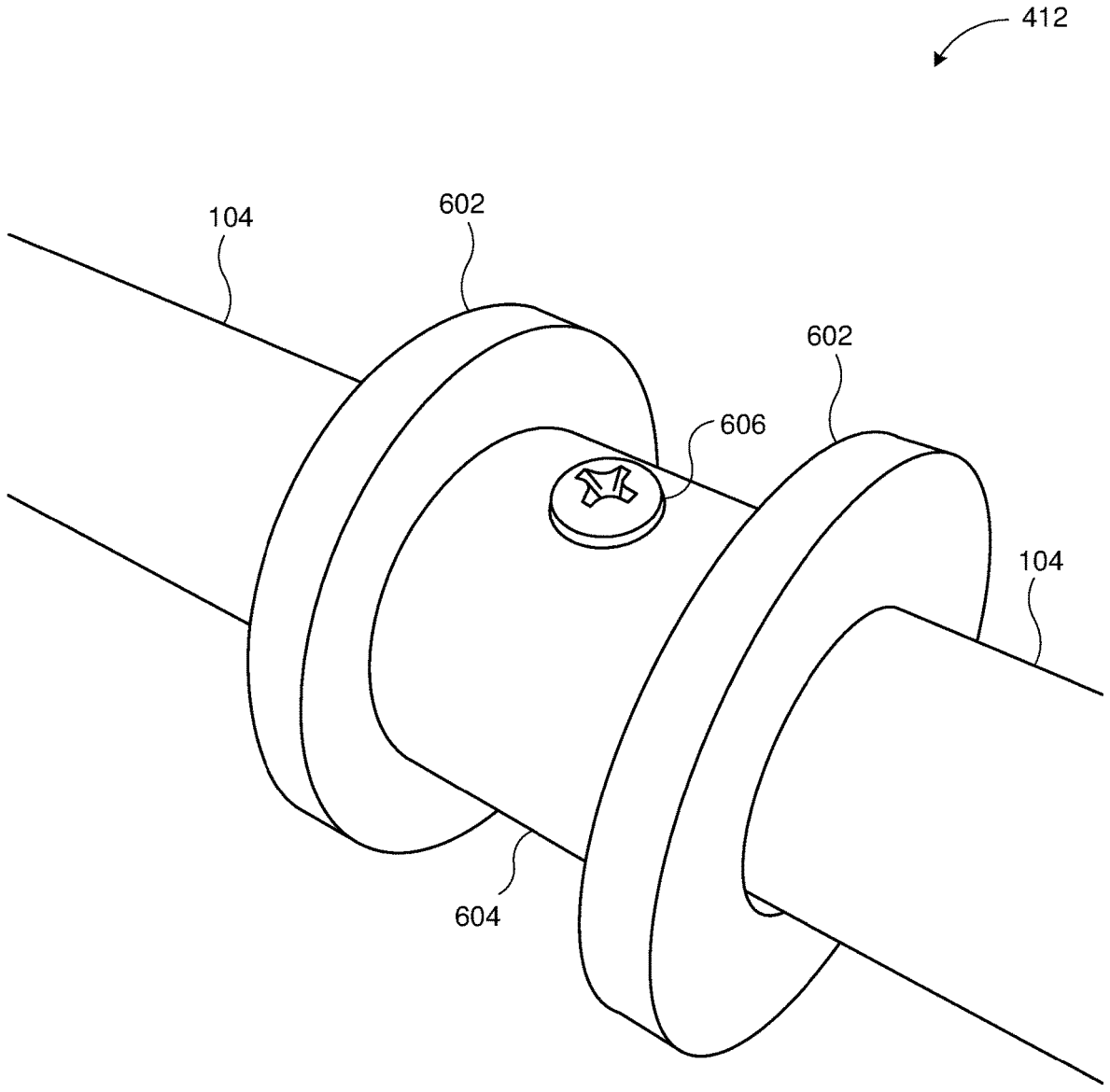
FIG. 6 shows a perspective view of one embodiment of a retaining collar of the elevated yard game system in accordance with one or more aspects of the present invention.

FIG. 6 shows a perspective view of one embodiment of a retaining collar 412 of the elevated yard game system 100 in accordance with one or more aspects of the present invention. The retaining collar 412 provides an easily-recognized location for installation of an inner horizontal member while providing a securing location for installation of the same.

In the illustrated embodiment, the retaining collar 412 is sized to fit on an exterior surface of the outer horizontal members 104 of the system 100. In some embodiments, the retaining collar 412 includes two parallel retaining rings 602 which extend radially outward from a retaining surface 604. The retaining rings 602 may be parallel on the sides of the retaining rings 602 which face one another to provide a tighter or more exact fit from the inner horizontal member. Alternatively, the faces may be sloped to provide an easier engagement of the inner horizontal member with the retaining collar 412.

In the illustrated embodiment, the retaining surface 604 provide a location for the inner horizontal member 108 to engage. The retaining surface 604 may be relatively low friction to resist wear and facilitate adjustment of the inner horizontal member 108 on the outer horizontal member 104. Alternatively, the retaining surface 604 may be textured, treated, or the like to increase friction in order to improve retention of the inner horizontal member 104 relative to the retaining collar 412.

The illustrated embodiment of the retaining collar 412 also includes a set screw 606. The set screw 606 may apply a retaining force on the outer horizontal member 104 to secure the retaining collar 412 along the length of the outer horizontal member 104. This may improve a consistency in the position of the various inner horizontal members 108 relative to one another and reduce a slipping of other movement of the inner horizontal members 108 along the outer horizontal members. Other structures such a slot and key, friction liner, sleeve, pin, and the like may be used to secure the retaining collar relative to the outer horizontal member.

Figure 7:
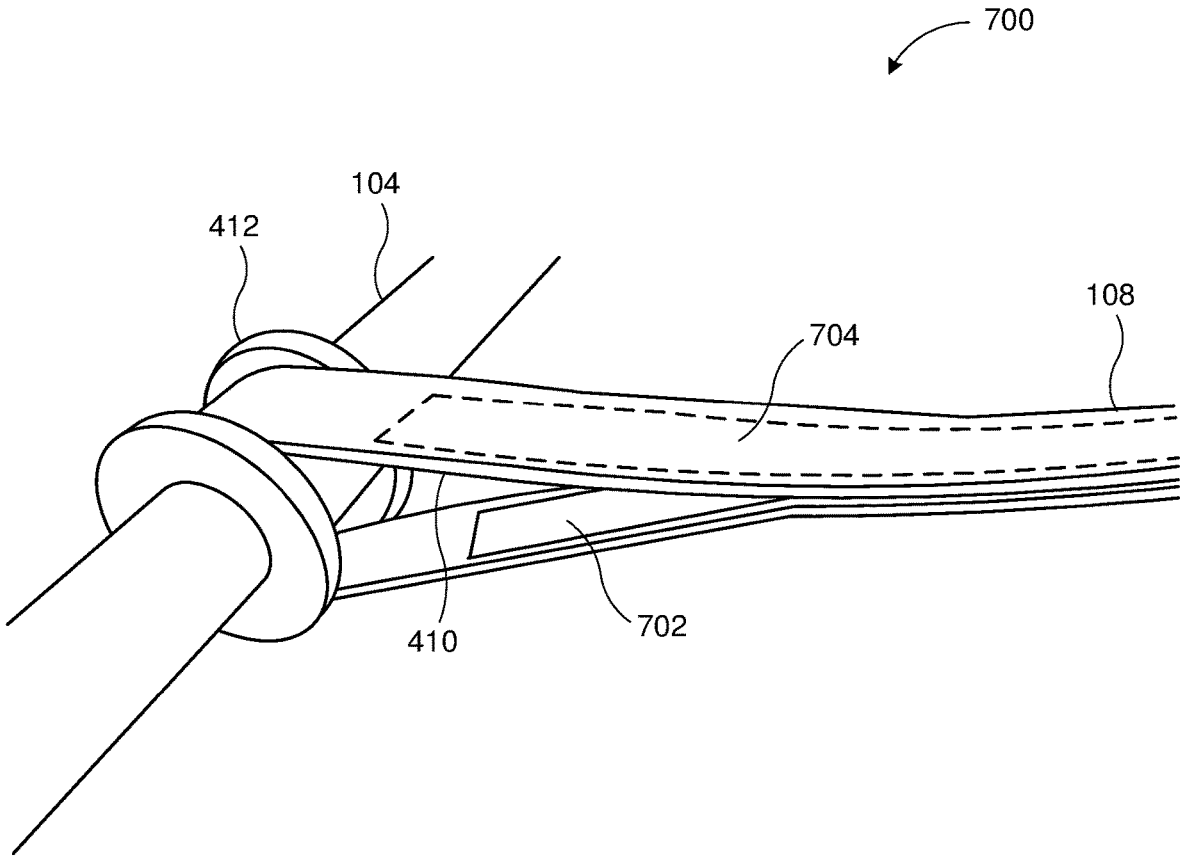
FIG. 7 shows a perspective view of one embodiment of a suspension attachment of the elevated yard game system in accordance with one or more aspects of the present invention.

FIG. 7 shows a perspective view of one embodiment of a suspension attachment 700 of the elevated yard game system in accordance with one or more aspects of the present invention. The suspension attachment 700 provides a connection that easily installed and adjusted to provide appropriate tension.

In the illustrated embodiment, the inner horizontal member 108 is secured to the outer horizontal member 104 at the retaining collar 412. The illustrated embodiment of the inner horizontal member 108 includes a first attachment structure 702 and a second attachment structure 704. As shown, the first attachment structure 702 may be configured to couple to the second attachment structure 704 to secure the inner horizontal member 108. The first attachment structure 702 may be separated from the second attachment structure 704 to provide a location on the inner horizontal member 108 to correspond to the retaining collar 412.

At least one of the first attachment structure 702 and the second attachment structure 704 may be coupled or otherwise connected to the inner horizontal member 108 in a removable or non-removable manner. For example, relative to the inner horizontal member 108, at least one of the first attachment structure 702 and the second attachment structure 704 may be sewn, magnetically secured, glued, snapped, buttoned, inserted, wrapped, zipped, or the like. The first attachment structure 702 and the second attachment structure 704 may be attached to the inner horizontal member 108 in similar or different manners. For example, one or both of the first attachment structure 702 and the second attachment structure 704 may be releasably coupled to the inner horizontal member 108. This may provide a quick release or safety release for the inner horizontal member 108 relative to the outer horizontal member 104. In some examples, the first attachment structure 702 and the second attachment structure 704 include hook-and-loop, magnetic, or similar interacting structures.

Figure 8:
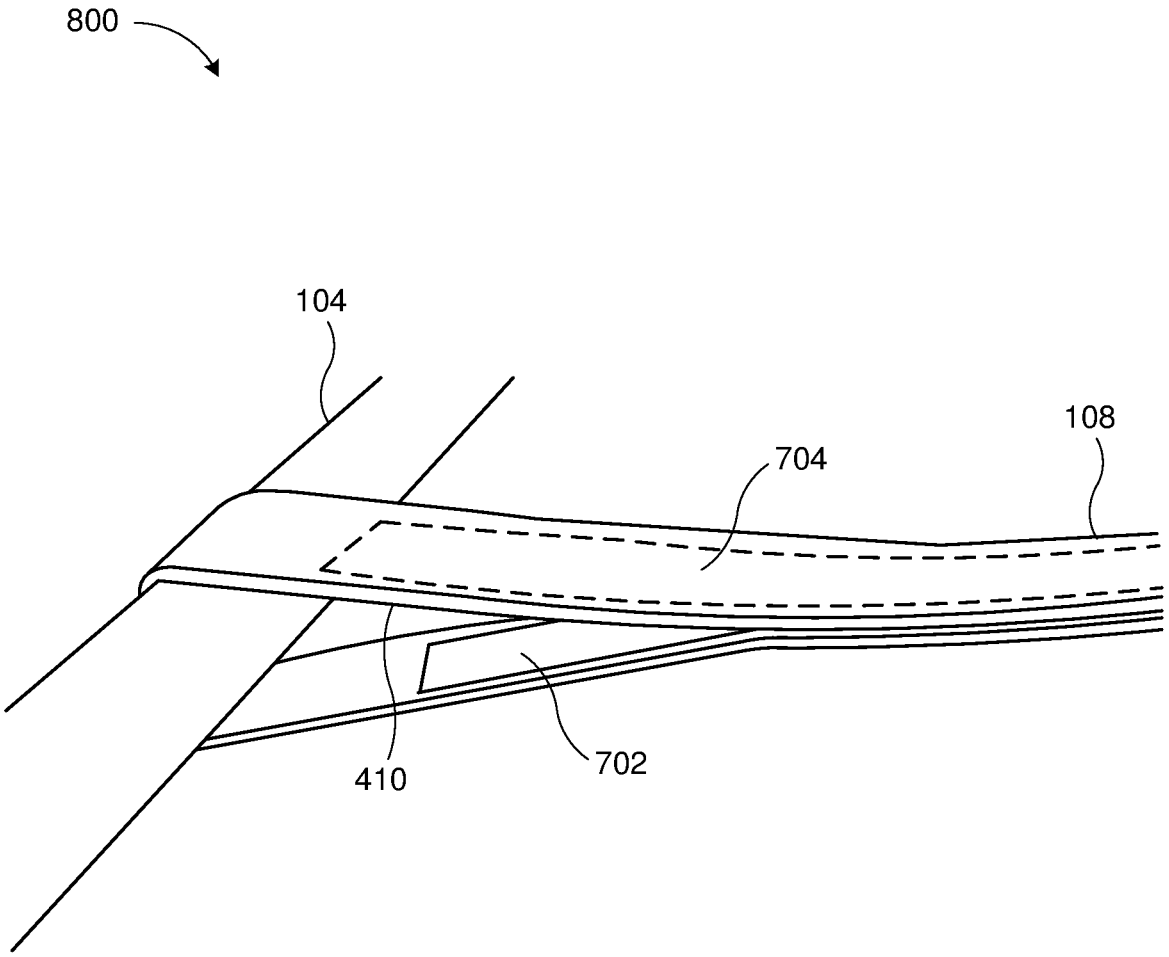
FIG. 8 shows a perspective view of another embodiment of the suspension attachment of the elevated yard game system in accordance with one or more aspects of the present invention.

FIG. 8 shows a perspective view of another embodiment of the suspension attachment 800 of the elevated yard game system 100 in accordance with one or more aspects of the present invention. the suspension attachment 800 is a collarless implementation that allows for direct attachment of the inner horizontal member 108 to the outer horizontal member 104 without the need to identify and engage with a collar. This allows for flexibility in setup, reduced cost, and reduced complexity and weight. For example, the user may set up the system 100 to use fewer or more inner horizontal members 108 to accommodate fewer or more players or arrangement of inner horizontal members 108.

In the illustrated embodiment, the inner horizontal member 108 is secured to the outer horizontal member 104 without the use of a retaining collar 412. As shown, the first attachment structure 702 may be configured to couple to the second attachment structure 704 to secure the inner horizontal member 108. The first attachment structure 702 may be separated from the second attachment structure 704 to provide a location on the inner horizontal member 108 to correspond to the outer horizontal member 104. In some embodiments, a portion of the inner horizontal member 108 corresponding to a contact point with the outer horizontal member 104 includes a friction coating or friction element.

Figure 9:
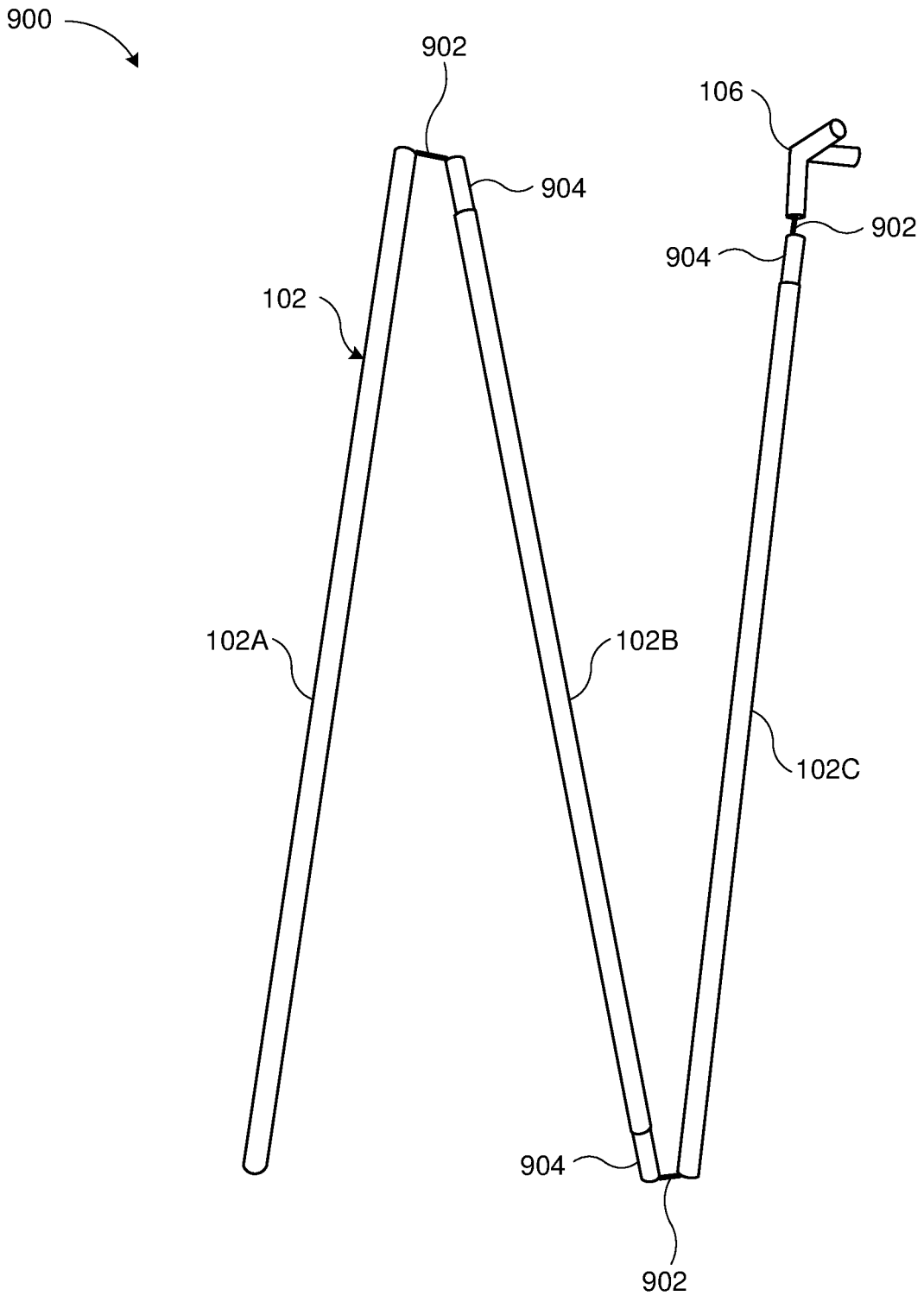
FIG. 9 shows a perspective view of one embodiment of the vertical supports of the elevated yard game system in accordance with one or more aspects of the present invention.

FIG. 9 shows a perspective view of one embodiment of the vertical supports 102 of the elevated yard game system 100 in accordance with one or more aspects of the present invention. The illustrated arrangement allows for easier organization of the system 100 as well as simplified and assisted setup.

As a preliminary matter, while FIG. 9 is described as relating to the vertical supports 102, the features and aspects described herein may also apply to the outer horizontal members 104. Additionally, while some embodiments of the vertical support 102 include a single pole, as shown, some embodiments of the vertical support 102 may include multiple segments. In the illustrated embodiment, the vertical support 102 includes a first vertical segment 102A, a second vertical segment 102B, and a third vertical segment 102C.

In the illustrated embodiment, an elastic element 902 is positioned within at least one of the first vertical segment 102A, the second vertical segment 102B, and the third vertical segment 102C to provide a retaining force pulling the first vertical segment 102A, the second vertical segment 102B, and the third vertical segment 102C together. In some embodiments, the elastic element 902 is a single elastic cord extending from the first vertical segment 102A, through the second vertical segment 102B, and to the third vertical segment 102C. In other embodiments, the elastic element 902 includes multiple sections positioned at an end of each of the first vertical segment 102A, the second vertical segment 102B, and the third vertical segment 102C.

In some embodiments, at least one of the first vertical segment 102A, the second vertical segment 102B, or the third vertical segment 102C includes a swaged portion 904. Swaging on the swaged portion 904 may be a narrowing or broadening of a diameter of the corresponding portion of the vertical segment 102 or other component. The swaged portion 904, on any one or more of the first vertical segment 102A, the second vertical segment 102B, or the third vertical segment 102C, may provide for insertion of the corresponding segment into another segment to connect the two together.

In some embodiments, the first vertical segment 102A is not swaged while the second vertical segment 102B is swaged at both ends and the third vertical segment 102C is swaged at an end corresponding to the elevation coupler 106. In other embodiments, the first vertical segment 102A and the third vertical segment 102C are swaged while the second vertical segment 102B is not swaged. Other arrangements of swaged ends on the vertical support 102 are contemplated. Additionally, the joining capability of swaging may be replicated by a collar, sleeve, insert, brace, or so forth.

Figure 10:
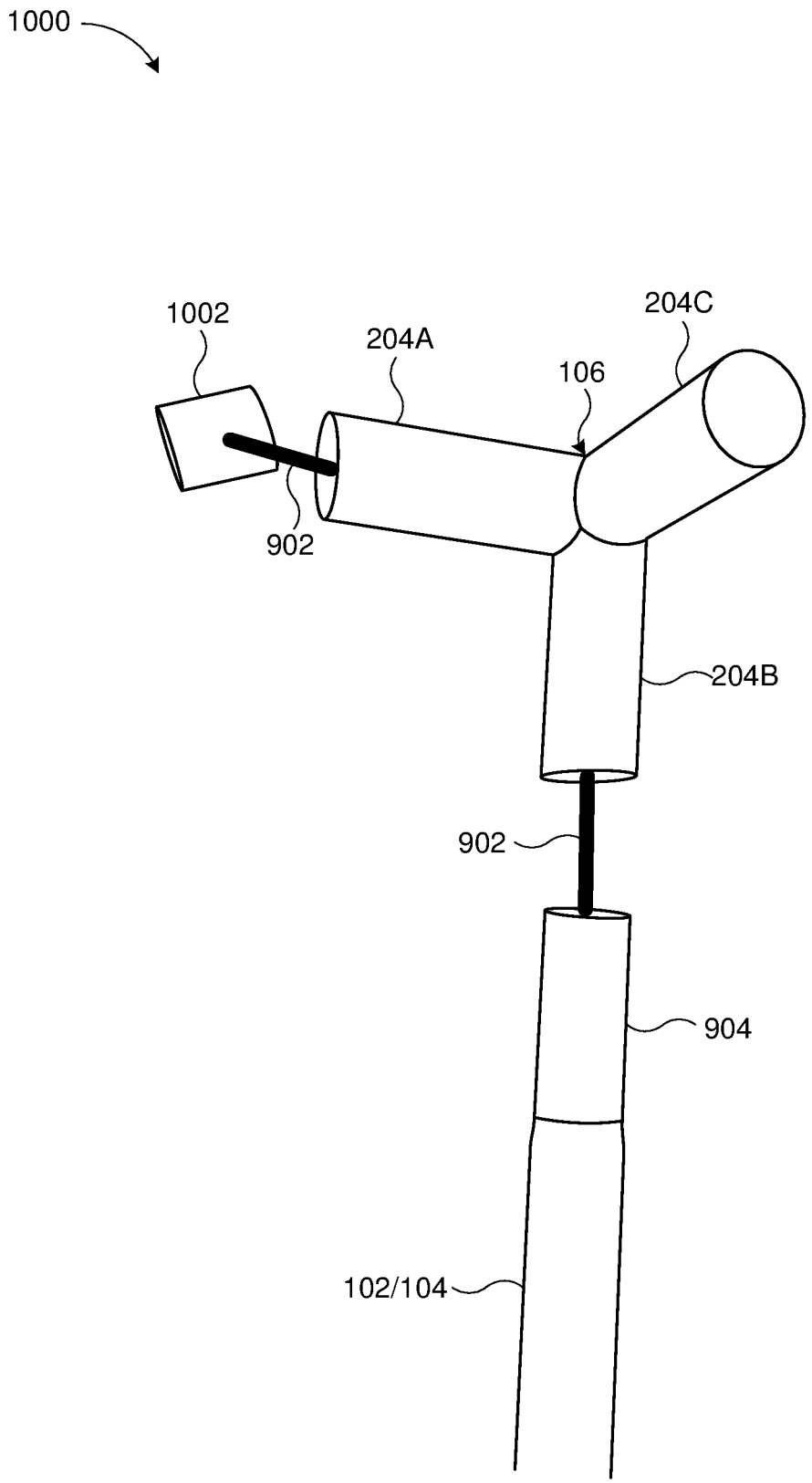
FIG. 10 shows a perspective view of one embodiment of a corner arrangement of the elevated yard game system in accordance with one or more aspects of the present invention.

FIG. 10 shows a perspective view of one embodiment of a corner arrangement 1000 of the elevated yard game system 100 in accordance with one or more aspects of the present invention. The illustrated arrangement allows for easier organization of the system 100 as well as simplified and assisted setup.

In the illustrated embodiment, a vertical support 102 or horizontal support 104 may be elastically connected to the elevation coupler 106 via an elastic element 902. In some embodiments, the elastic element 902 is coupled, at one end, to a stopper 1002. The stopper 1002 may be sized to fit within the elevation coupler 106 but unable to turn within the elevation coupler 106. For example, the stopper 1002 may be coupled to the elastic element 902 with the elastic element 902 passing into a first sleeve 204A of the elevation coupler 106 and through a second sleeve 204B of the elevation coupler 106. In some embodiment, the elastic element 902 is pulled tight, the stopper 1002 may be pulled into the first sleeve 204A and stop at an intersection of the first sleeve 204A and the second sleeve 204B as the stopper 1002 is geometrically incapable of turning from the first sleeve 204A to the second sleeve 204B. This forms an anchor for the elastic element 902 to secure the vertical support 102 or horizontal support 104 relative to the elevation coupler 106.

Figure 11:
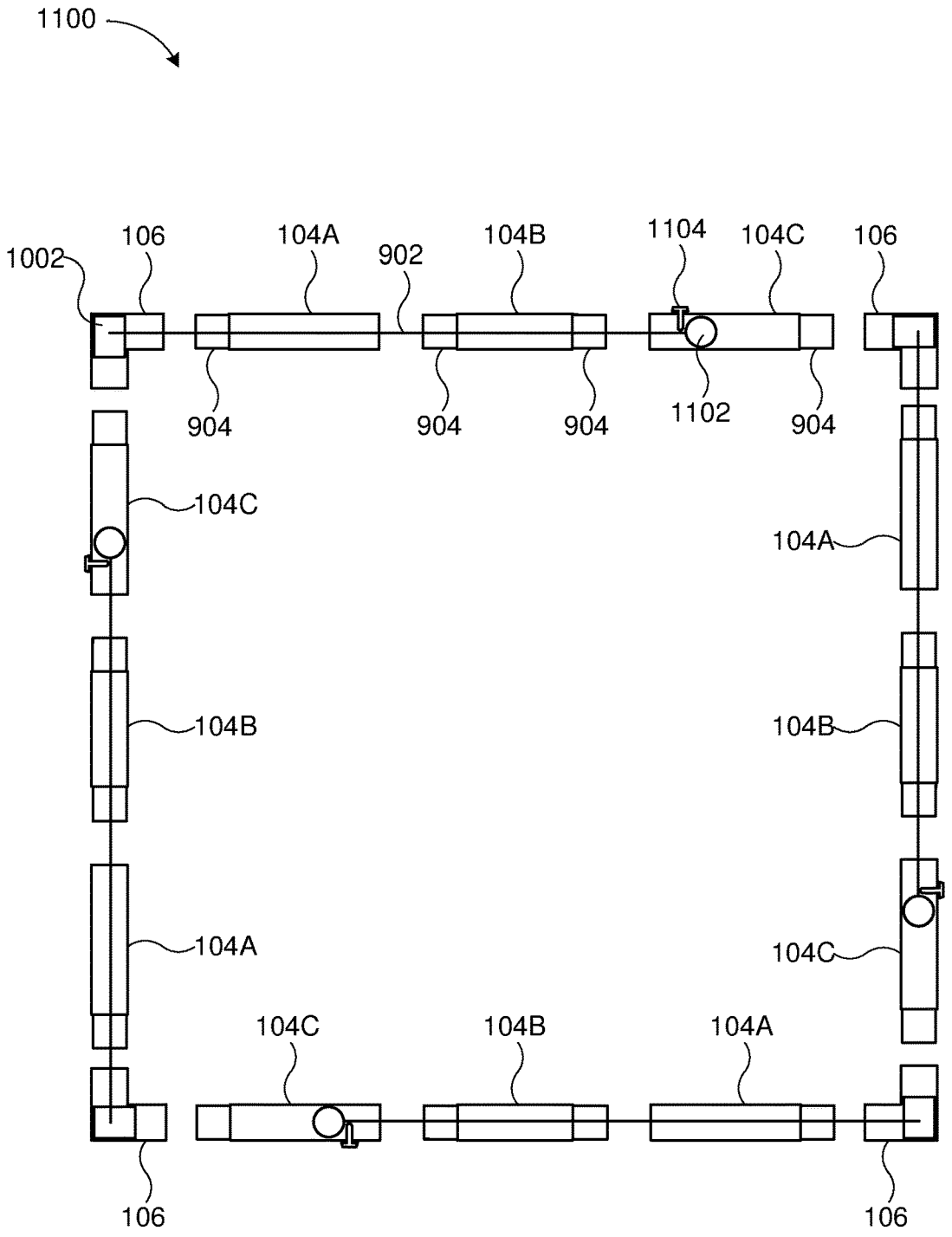
FIG. 11 shows an exploded schematic overhead view of one embodiment of the elevated yard game system in accordance with one or more aspects of the present invention.

FIG. 11 shows an exploded schematic overhead view of one embodiment of an upper portion 1100 the elevated yard game system 100 in accordance with one or more aspects of the present invention. The illustrated arrangement allows for easier organization of the system 100 as well as simplified and assisted setup.

In the illustrated embodiment, the elevation couplers 106 are positioned at the corners with the outer horizontal members 104 between each of the elevation couplers 106. In the illustrated embodiment, each of the horizontal members 104 includes a first horizontal segment 104A, a second horizontal segment 104B, and a third horizontal segment 104C. In other embodiments, the outer horizontal members 104 include fewer or more than three segments.

As illustrated, some embodiments of the horizontal segments 104A-C includes swaged portions 904 to fit with one another or with the elevation couplers 106. Some embodiments of the third horizontal segment 104 include a catch ball 1102. The catch ball 1102 may be sized to fit within the third horizontal segment 104C. In some embodiments, the catch ball 1102 is coupled to the elastic element 902. The catch ball 1102 may act as a stop to allow the elastic element 902 to apply a force drawing the third horizontal segment 104C toward the corresponding elevation coupler 106 and the stopper 1002 disposed within the elevation coupler 106. In some embodiments, because the first horizontal segment 104A and the second horizontal segment 104B are positioned on the elastic element 902 between the third horizontal segment 104*c* and the elevation coupler 106, the elastic element 902 operates to hold the horizontal segments 104A-C in an assembled arrangement relative to one another and the elevation coupler 106.

In some embodiments, a retainer 1104 is incorporated into the third horizontal segment 104C to retain the catch ball 1102 within the third horizontal segment 104C. In some embodiments, the retainer 1104 is removable from the third horizontal segment 104C. In other embodiments, the retainer 1104 is adjustable relative to the third horizontal segment 104C. For example, the retainer 1104 may include a screw, bolt, pin, switch, latch, or so forth to act as a barrier to the passage of the catch ball 1102. In some embodiments, the retainer 1104 is a unified feature of the third horizontal segment 140C. For example, the retainer 1104 may be a pinched portion, a flange, vane, ring, partial internal wall, or so forth to reduce internal space within the third horizontal segment 104C sufficient to resist passage of the catch ball 1102 past the retainer 1104. In some embodiments, a position of the retainer 1104 along a length of the third horizontal segment 104C may be adjustable to adjust a tension or length of the elastic element 902.

Figure 12:
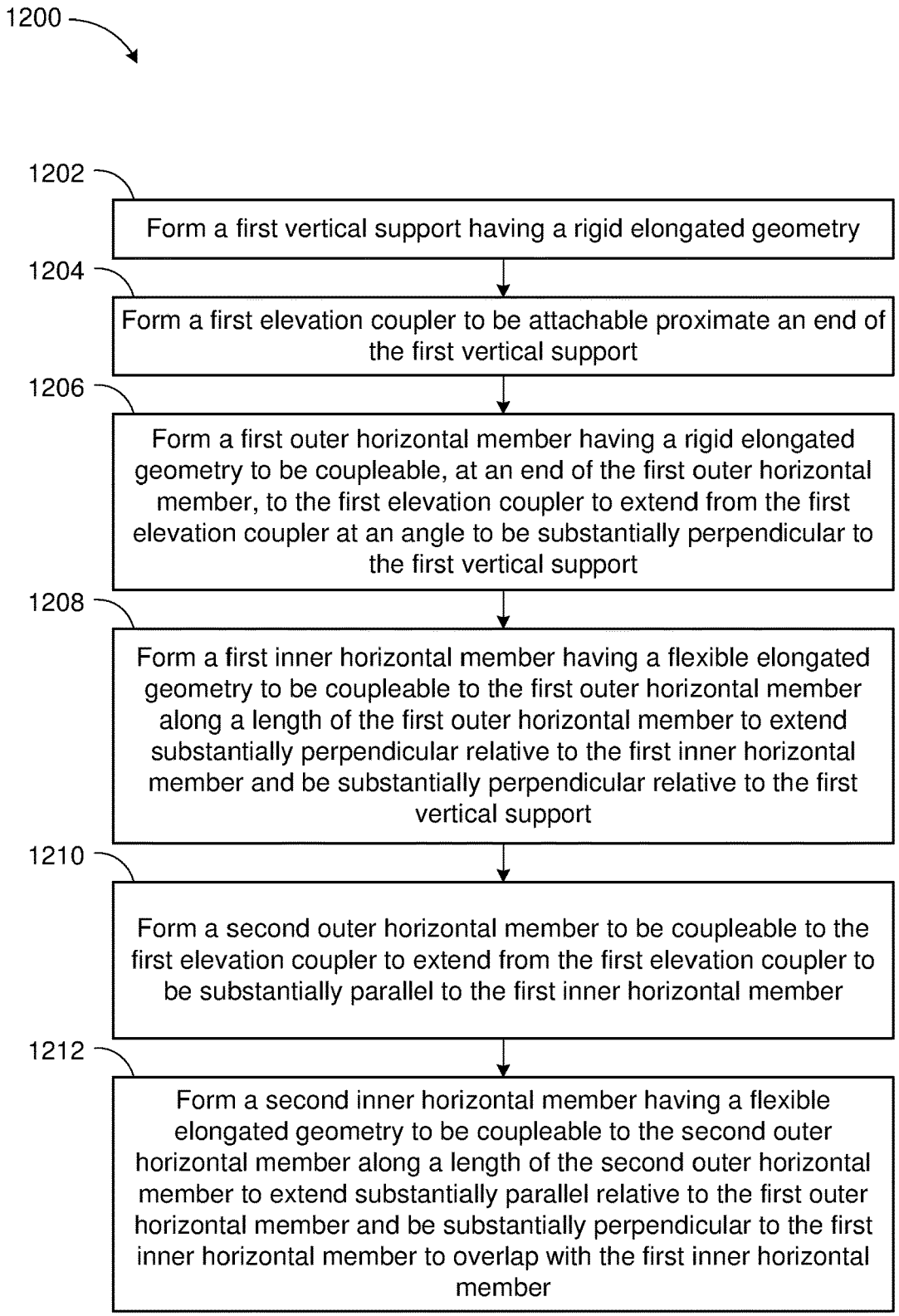
FIG. 12 shows a flow diagram of one embodiment of a method in accordance with one or more aspects of the present invention.

FIG. 12 shows a flow diagram of one embodiment of a method 1200 in accordance with one or more aspects of the present invention. The method 1200 may include forming a first vertical support having a rigid elongated geometry (Block 1202). For example, the first vertical support may include a tube such as an aluminum tube or other hollow or non-hollow component.

The method 1200 may include forming a first elevation coupler to be attachable proximate an end of the first vertical support (Block 1204). For example, the first elevation coupler may include sleeves to receive the end of the first vertical support. The method 1200 may include forming a first outer horizontal member having a rigid elongated geometry to be coupleable, at an end of the first outer horizontal member, to the first elevation coupler to extend from the first elevation coupler at an angle to be substantially perpendicular to the first vertical support (Block 1206). For example, the first outer horizontal member may be configured to extend horizontally outward from the first elevation coupler while the first vertical support extends vertically downward from the first elevation coupler.

The method 1200 may include forming a first inner horizontal member having a flexible elongated geometry to be coupleable to the first outer horizontal member along a length of the first outer horizontal member to extend substantially perpendicular relative to the first inner horizontal member and be substantially perpendicular relative to the first vertical support (Block 1208). For example, the first inner horizontal member may be attached to a point along a length of the first outer horizontal member to extend horizontally away from the first outer horizontal member.

The method 1200 may include forming a second outer horizontal member to be coupleable to the first elevation coupler to extend from the first elevation coupler to be substantially parallel to the first inner horizontal member (Block 1210). For example, the second outer horizontal member may extend horizontally from the first elevation coupler at approximately a right angle from the first outer horizontal member.

The method 1200 may include forming a second inner horizontal member having a flexible elongated geometry to be coupleable to the second outer horizontal member along a length of the second outer horizontal member to extend substantially parallel relative to the first outer horizontal member and be substantially perpendicular to the first inner horizontal member to overlap with the first inner horizontal member (Block 1212). For example, the first inner horizontal member and the second inner horizontal member may overlap each other as they extend horizontally from the first outer horizontal member and the second outer horizontal member, respectively.

A feature illustrated in one of the figures may be the same as or similar to a feature illustrated in another of the figures. Similarly, a feature described in connection with one of the figures may be the same as or similar to a feature described in connection with another of the figures. The same, or similar, features may be noted by the same, or similar, reference characters unless expressly described otherwise. Additionally, the description of a particular figure may refer to a feature not shown in the particular figure. The feature may be illustrated in and/or further described in connection with another figure.

Elements of processes (i.e. methods) described herein may be executed in one or more ways such as by a human, by a processing device, by mechanisms operating automatically or under human control, and so forth. Additionally, although various elements of a process may be depicted in the figures in a particular order, the elements of the process may be performed in one or more different orders without departing from the substance and spirit of the disclosure herein.

The foregoing description sets forth numerous specific details such as examples of specific systems, components, methods and so forth, in order to provide a good understanding of several implementations. It will be apparent to one skilled in the art, however, that at least some implementations may be practiced without these specific details. In other instances, well-known components or methods are not described in detail or are presented in simple block diagram format in order to avoid unnecessarily obscuring the present implementations. Thus, the specific details set forth above are merely exemplary. Particular implementations may vary from these exemplary details and still be contemplated to be within the scope of the present implementations.

Related elements in the examples and/or embodiments described herein may be identical, similar, or dissimilar in different examples. For the sake of brevity and clarity, related elements may not be redundantly explained. Instead, the use of a same, similar, and/or related element names and/or reference characters may cue the reader that an element with a given name and/or associated reference character may be similar to another related element with the same, similar, and/or related element name and/or reference character in an example explained elsewhere herein. Elements specific to a given example may be described regarding that particular example. A person having ordinary skill in the art will understand that a given element need not be the same and/or similar to the specific portrayal of a related element in any given figure or example in order to share features of the related element.

It is to be understood that the foregoing description is intended to be illustrative and not restrictive. Many other implementations will be apparent to those of skill in the art upon reading and understanding the above description. The scope of the present implementations should, therefore, be determined with reference to the appended claims, along with the full scope of equivalents to which such claims are entitled.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements.

As used herein "same" means sharing all features and "similar" means sharing a substantial number of features or sharing materially important features even if a substantial number of features are not shared. As used herein "may" should be interpreted in a permissive sense and should not be interpreted in an indefinite sense. Additionally, use of "is" regarding examples, elements, and/or features should be interpreted to be definite only regarding a specific example and should not be interpreted as definite regarding every example. Furthermore, references to "the disclosure" and/or "this disclosure" refer to the entirety of the writings of this document and the entirety of the accompanying illustrations, which extends to all the writings of each subsection of this document, including the Title, Background, Brief description of the Drawings, Detailed Description, Claims, Abstract, and any other document and/or resource incorporated herein by reference.

As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

Where multiples of a particular element are shown in a FIG., and where it is clear that the element is duplicated throughout the FIG., only one label may be provided for the element, despite multiple instances of the element being present in the FIG. Accordingly, other instances in the FIG. of the element having identical or similar structure and/or function may not have been redundantly labeled. A person having ordinary skill in the art will recognize based on the disclosure herein redundant and/or duplicated elements of the same FIG. Despite this, redundant labeling may be included where helpful in clarifying the structure of the depicted examples.

The Applicant(s) reserves the right to submit claims directed to combinations and sub-combinations of the disclosed examples that are believed to be novel and non-obvious. Examples embodied in other combinations and sub-combinations of features, functions, elements and/or properties may be claimed through amendment of those claims or presentation of new claims in the present application or in a related application. Such amended or new claims, whether they are directed to the same example or a different example and whether they are different, broader, narrower or equal in scope to the original claims, are to be considered within the subject matter of the examples described herein.

The invention claimed is:

1. A system comprising:

a first vertical support having a rigid elongated geometry;

a second vertical support parallel to the first vertical support and positioned at a first distance from the first vertical support, wherein the second vertical support has a rigid elongated geometry;

a third vertical support parallel to the first vertical support and the second vertical support at the first distance from the second vertical support, wherein the third vertical support has a rigid elongated geometry;

a fourth vertical support parallel to the first vertical support, the second vertical support, and the third vertical support at the first distance from the third vertical support and the first vertical support, wherein the fourth vertical support has a rigid elongated geometry;

a first elevation coupler releasably attachable proximate an end of the first vertical support;

a second elevation coupler releasably attachable proximate an end of the second vertical support;

a third elevation coupler releasably attachable proximate an end of the third vertical support;

a fourth elevation coupler releasably attachable proximate an end of the fourth vertical support;

a first outer horizontal member releasably coupleable to extend between the first elevation coupler and the second elevation coupler to be oriented substantially perpendicular to the first vertical support, wherein the first outer horizontal member has a rigid elongated geometry;

a second outer horizontal member coupleable to extend between the second elevation coupler and the third elevation coupler to be oriented substantially perpendicular to the first outer horizontal member and perpendicular to the first vertical support, wherein the second outer horizontal member has a rigid elongated geometry;

a third outer horizontal member coupleable to extend between the third elevation coupler and the fourth elevation coupler to be oriented substantially parallel to the first outer horizontal member and perpendicular to the first vertical support, wherein the third outer horizontal member has a rigid elongated geometry;

a fourth outer horizontal member coupleable to extend between the fourth elevation coupler and the first elevation coupler to be oriented substantially parallel to the second outer horizontal member and perpendicular to the first vertical support, wherein the fourth outer horizontal member has a rigid elongated geometry;

a first inner horizontal member releasably coupleable to a point along a length of the first outer horizontal member to extend, and releasably couple, to a point along a length of the third outer horizontal member to be oriented substantially perpendicular relative to the first outer horizontal member, substantially perpendicular relative to the first vertical support, and substantially parallel to the second outer horizontal member and the fourth outer horizontal member, wherein the first inner horizontal member has a flexible elongated geometry;

a second inner horizontal member releasably coupleable to a point along a length of the second outer horizontal member to extend, and releasably couple, to a point along a length of the fourth outer horizontal member to be oriented substantially parallel relative to the first outer horizontal member, substantially perpendicular relative to the first vertical support, and substantially perpendicular to the second outer horizontal member and the fourth outer horizontal member, wherein the first inner horizontal member has a flexible elongated geometry, wherein the second inner horizontal member overlaps the first inner horizontal member to form a grid in an elevated position to provide an arrangement suitable for a game, the grid comprising a first square and a second square wherein the first square and the second square are sized to allow a player to stand beneath the first square and direct a ball up through the first square and allow the ball to fall into the second square;

wherein the first vertical support is adjustable in length to adjust a height of the grid to accommodate a range of players and setup situations.

2. The system of claim 1, wherein the first vertical support and the first outer horizontal support comprises a tubular structure to provide a rigid and lightweight structure.

3. The system of claim 1, wherein the first outer horizontal member comprises a first horizontal segment and a second horizontal segment.

4. The system of claim 1, wherein the first outer horizontal member is coupleable to at least one of the first elevation coupler or the second elevation coupler via an elastic element to maintain the first outer horizontal member in connection with the at least one of the first elevation coupler or the second elevation coupler.

5. The system of claim 1, wherein the first inner horizontal member comprises a strap.

6. The system of claim 1, wherein the first inner horizontal member comprises a suspension attachment to couple the first inner horizontal member to the first outer horizontal member.

7. A system comprising:

a first vertical support having a rigid elongated geometry;

a second vertical support parallel to the first vertical support and positioned at a first distance from the first vertical support, wherein the second vertical support has a rigid elongated geometry;

a third vertical support parallel to the first vertical support and the second vertical support at the first distance from the second vertical support, wherein the third vertical support has a rigid elongated geometry;

a fourth vertical support parallel to the first vertical support, the second vertical support, and the third vertical support at the first distance from the third vertical support and the first vertical support, wherein the fourth vertical support has a rigid elongated geometry;

a first elevation coupler releasably attachable proximate an end of the first vertical support;

a second elevation coupler releasably attachable proximate an end of the second vertical support;

a third elevation coupler releasably attachable proximate an end of the third vertical support;

a fourth elevation coupler releasably attachable proximate an end of the fourth vertical support;

a first outer horizontal member releasably coupleable to extend between the first elevation coupler and the second elevation coupler to be oriented substantially perpendicular to the first vertical support, wherein the first outer horizontal member has a rigid elongated geometry;

a second outer horizontal member coupleable to extend between the second elevation coupler and the third elevation coupler to be oriented substantially perpendicular to the first outer horizontal member and perpendicular to the first vertical support, wherein the second outer horizontal member has a rigid elongated geometry;

a third outer horizontal member coupleable to extend between the third elevation coupler and the fourth elevation coupler to be oriented substantially parallel to the first outer horizontal member and perpendicular to the first vertical support, wherein the third outer horizontal member has a rigid elongated geometry;

a fourth outer horizontal member coupleable to extend between the fourth elevation coupler and the first elevation coupler to be oriented substantially parallel to the second outer horizontal member and perpendicular to the first vertical support, wherein the fourth outer horizontal member has a rigid elongated geometry;

a first inner horizontal member releasably coupleable to a point along a length of the first outer horizontal member to extend, and releasably couple, to a point along a length of the third outer horizontal member to be oriented substantially perpendicular relative to the first outer horizontal member, substantially perpendicular relative to the first vertical support, and substantially parallel to the second outer horizontal member and the fourth outer horizontal member, wherein the first inner horizontal member has a flexible elongated geometry;

a second inner horizontal member releasably coupleable to a point along a length of the second outer horizontal member to extend, and releasably couple, to a point along a length of the fourth outer horizontal member to be oriented substantially parallel relative to the first outer horizontal member, substantially perpendicular relative to the first vertical support, and substantially perpendicular to the second outer horizontal member and the fourth outer horizontal member, wherein the first inner horizontal member has a flexible elongated geometry, wherein the second inner horizontal member overlaps the first inner horizontal member to form a grid in an elevated position to provide an arrangement suitable for a game, the grid comprising a first square and a second square wherein the first square and the second square are sized to allow a player to stand beneath the first square and direct a ball up through the first square and allow the ball to fall into the second square;

wherein the first vertical support is coupled to the first elevation coupler via an elastic element to maintain the first vertical support in connection with the first elevation coupler in a setup or transport arrangement.

8. The system of claim 7, wherein the first vertical support is adjustable in length to adjust a height of the grid to accommodate a range of players and setup situations.

9. A system comprising:

a first vertical support having a rigid elongated geometry;

a first elevation coupler attachable proximate an end of the first vertical support;

a first outer horizontal member having a rigid elongated geometry and coupleable, at a first end of the first outer horizontal member, to the first elevation coupler to extend from the first elevation coupler at an angle substantially perpendicular to the first vertical support;

a first inner horizontal member having a flexible elongated geometry and releasably coupleable to the first outer horizontal member along a length of the first outer horizontal member to extend substantially perpendicular relative to the first outer horizontal member and substantially perpendicular relative to the first vertical support;

a second outer horizontal member coupleable to the first elevation coupler to extend from the first elevation coupler substantially parallel to the first inner horizontal member; and a second inner horizontal member having a flexible elongated geometry and releasably coupleable to the second outer horizontal member along a length of the second outer horizontal member to extend substantially parallel to the first outer horizontal member and substantially perpendicular to the first inner horizontal member to overlap with the first inner horizontal member to form a grid in an elevated position to provide an arrangement suitable for a game, the grid comprising a first square and a second square wherein the first square and the second square are sized to allow a player to stand beneath the first square and direct a ball up through the first square and into the second square;

wherein the first vertical support is adjustable in length to adjust a height of the grid to accommodate a range of players and setup situations.

10. The system of claim 9, wherein the first inner horizontal member comprises a strap configured to loop around the first outer horizontal member and attach to a first attachment structure disposed on the first inner horizontal member.

11. The system of claim 9, further comprising an elastic element coupled to a stopper configured to anchor within the first elevation coupler.

12. The system of claim 9, wherein the first outer horizontal member comprises a first horizontal segment coupleable to a second horizontal segment and the first horizontal segment and the second horizontal segment are coupled to the first elevation coupler via an elastic element.

13. The system of claim 12, further comprising a catch ball coupled to one end of the elastic element, wherein the catch ball is configured to secure the elastic element within one of the first horizontal segment and the second horizontal segment.

14. The system of claim 9, wherein the first vertical support comprises a first vertical segment coupled to a second vertical segment via an elastic element.

15. A method comprising;

forming a first vertical support having a rigid elongated geometry;

forming a first elevation coupler to be attachable proximate an end of the first vertical support;

forming a first outer horizontal member having a rigid elongated geometry to be coupleable, at an end of the first outer horizontal member, to the first elevation coupler to extend from the first elevation coupler at an angle to be substantially perpendicular to the first vertical support;

forming a first inner horizontal member having a flexible elongated geometry to be releasably coupleable to the first outer horizontal member along a length of the first outer horizontal member to extend substantially perpendicular relative to the first outer horizontal member and be substantially perpendicular relative to the first vertical support;

forming a second outer horizontal member to be coupleable to the first elevation coupler to extend from the first elevation coupler to be substantially parallel to the first inner horizontal member;

forming a second inner horizontal member having a flexible elongated geometry to be releasably coupleable to the second outer horizontal member along a length of the second outer horizontal member to extend substantially parallel relative to the first outer horizontal member and be substantially perpendicular to the first inner horizontal member to overlap with the first inner horizontal member to form a grid in an elevated position to provide an arrangement suitable for a game, the grid comprising a first square and a second square wherein the first square and the second square are sized to allow a player to stand beneath the first square and direct a ball up through the first square and into the second square; and disposing a securing mechanism to releasably couple at least one of the first vertical support or the first outer horizontal member to the first elevation coupler.

16. The method of claim 15, further comprising swaging an end of the first vertical support to releasably couple to the first elevation coupler.

17. The method of claim 15, further comprising disposing an elastic element to apply a compressive force drawing at least one of the first vertical support or the first outer horizontal member toward the first elevation coupler.

18. The method of claim 17, further comprising disposing a catch ball at one end of the elastic element to secure the one end of the elastic element relative to the least one of the first vertical support or the first outer horizontal member.

19. The method of claim 18, further comprising disposing a stopper at another end of the elastic element to secure the other end of the elastic element relative to the first vertical support.

20. The method of claim 15, further comprising adjusting a length of the first vertical support to adjust a height of the grid to accommodate a range of players and setup situations.

* * * * *